US008156569B2

(12) United States Patent
Cripton et al.

(10) Patent No.: US 8,156,569 B2
(45) Date of Patent: Apr. 17, 2012

(54) PROTECTIVE HELMET WITH MOVABLE OUTER SHELL RELATIVE TO INNER SHELL

(75) Inventors: Peter Alec Cripton, Vancouver (CA); Timothy Scott Nelson, Vancouver (CA)

(73) Assignee: The University of British Columbia, Vancouver (CA)

( * ) Notice: Subject to any disclaimer, the term of this patent is extended or adjusted under 35 U.S.C. 154(b) by 482 days.

(21) Appl. No.: 12/445,063

(22) PCT Filed: Oct. 12, 2007

(86) PCT No.: PCT/CA2007/001799

§ 371 (c)(1), (2), (4) Date: Apr. 9, 2009

(87) PCT Pub. No.: WO2008/046196

PCT Pub. Date: Apr. 24, 2008

(65) Prior Publication Data

US 2010/0101005 A1 Apr. 29, 2010

Related U.S. Application Data

(60) Provisional application No. 60/851,293, filed on Oct. 13, 2006.

(51) Int. Cl.
*F41H 1/04* (2006.01)

(52) U.S. Cl. ..... 2/6.8; 2/411

(58) Field of Classification Search ..... 2/411, 410, 2/412, 414, 455, 92, 267, 44, 45, 462–464, 2/467, 459, 461, 102, 2.5, 913, 22, 2, 24, 2/25, 62, 425, 6.1, 6.6, 6.8, 5, 468, 421
See application file for complete search history.

(56) References Cited

U.S. PATENT DOCUMENTS 3,860,966 A 1/1975 Brown et al.
4,012,794 A * 3/1977 Nomiyama ..... 2/411
4,409,689 A * 10/1983 Buring et al. ..... 2/22
(Continued)

FOREIGN PATENT DOCUMENTS

CA 1107901 9/1981
(Continued)

OTHER PUBLICATIONS

Freiholtz, A Numerical Analysis of an Impact Protection System with Focus on the Head, Master Thesis, Royal Institute of Technology, Sweden, 2000.

*Primary Examiner* — Gary L Welch
*Assistant Examiner* — Khaled Annis
(74) *Attorney, Agent, or Firm* — Oyen Wiggs Green & Mutala LLP

(57) ABSTRACT

A helmet is wearable on a user's head for mitigating neck injury. The helmet incorporates an outer member which defines a concavity; an inner member, at least a portion of which is located within the concavity; and a path-motion guide mechanism which couples the inner member to the outer member. The path-motion guide mechanism permits guided relative movement between the inner member and the outer member in response to an impact force. The guided relative movement is constrained to one or more predetermined paths and comprises, for each of the one or more predetermined paths, relative translation and/or rotation between the inner and outer members.

34 Claims, 11 Drawing Sheets

U.S. PATENT DOCUMENTS

| | | | | |
|---|---|---|---|---|
| 4,769,857 | A * | 9/1988 | Cianfanelli et al. | 2/424 |
| 5,123,408 | A | 6/1992 | Gaines | |
| 5,287,562 | A | 2/1994 | Rush, III | |
| 5,553,330 | A | 9/1996 | Carveth | |
| 5,956,777 | A | 9/1999 | Popovich | |
| 6,324,700 | B1 * | 12/2001 | McDougall | 2/417 |
| 6,378,140 | B1 * | 4/2002 | Abraham et al. | 2/411 |
| 6,658,671 | B1 | 12/2003 | Von Holst et al. | |
| 6,886,186 | B2 | 5/2005 | Jansen | |
| 2004/0019956 | A1 * | 2/2004 | Arai | 2/410 |
| 2004/0078861 | A1 * | 4/2004 | Eghamn | 2/24 |
| 2004/0168246 | A1 * | 9/2004 | Phillips | 2/411 |
| 2004/0194194 | A1 | 10/2004 | McNeil et al. | |
| 2005/0268387 | A1 * | 12/2005 | Wong | 2/455 |

FOREIGN PATENT DOCUMENTS

| | | |
|---|---|---|
| CA | 2601526 | 9/2006 |
| EP | 1103194 | 5/2001 |
| WO | 0145526 | 6/2001 |

* cited by examiner

PROTECTIVE HELMET WITH MOVABLE OUTER SHELL RELATIVE TO INNER SHELL

RELATED APPLICATIONS

This application claims the benefit of the priority date of U.S. application No. 60/851,293 filed 13 Oct. 2006 which is hereby incorporated herein by reference.

TECHNICAL FIELD

The invention relates to apparatus for mitigating spinal cord injury. Particular embodiments of the invention provide protective headgear apparatus for mitigating spinal cord injury.

BACKGROUND

Spinal cord injuries can be medically devastating events which may leave victims partially or completely paralyzed below the level of the injury. Many spinal cord injuries are presently irreversible.

Axial compressive type neck injuries are an example of a particularly devastating type of spinal cord injury. Alternate terms for an axial compression injury include a vertebral compression fracture, axial compression fracture, axial compression burst fracture, or an axial load injury. Cervical spine injuries of this type at the C1 or C2 vertebrae are frequently fatal, and injuries at the C3-C7 vertebrae frequently result in paralysis.

Axial compressive type neck injuries may result from an inverted fall onto one's head, or a head-first impact with, for example, another person, or another object such as a wall, a swimming pool floor or the roof of a car. This type of injury may occur in accidents, falls and/or collisions in a wide range of activities including, without limitation, accidents, falls and/or collisions involving vehicles, such as bicycles, automobiles, motorcycles and the like, accidents, falls and/or collisions which occur in sports, such as skateboarding, rollerblading, skiing, snowboarding, hockey, football, equestrian events, swimming, diving. This type of injury may also result from an accidental fall from heights or the like. Many of such activities already involve the use of an engineered interface, such as a helmet or an automobile roof, between the head and the contact surface. Current designs for such engineered interfaces have had limited utility in preventing neck injuries.

Most current designs for helmets and other protective headgear are primarily designed to protect the head (e.g. from impact). These prior art headgear designs offer limited, if any, protection for the neck. Current helmet designs are effective in protecting against head injury due to linear acceleration and object penetration, but are more limited in what protection may be offered to the cervical spine. Typical helmet designs include an outer shell which may be fabricated from a variety of materials. Such materials may include composites such as Kevlar™ (aramid fiber), carbon fibre reinforced plastics, glass reinforced plastics, ABS (acrylonitrile butadiene styrene) plastic, polycarbonate plastics and the like. Prior art helmets typically include two layers of inner padding within their outer shell. The most immediate to the scalp may be referred to as a comfort liner and is typically made of low density foam. The intermediate padding layer (between the outer shell and the comfort liner) typically comprises an energy-absorbing material, such as expanded polystyrene or the like. The intermediate padding layer in motorcycle helmets typically has a density of 50-60 g/liter.

Some examples of modified helmet designs are known in the prior art. Such modified helmet designs include:

U.S. patent publication No. 2004/0168246 (Phillips);

U.S. Pat. No. 5,287,862 (Rush, III);

U.S. Pat. No. 5,553,330 (Carveth); and

U.S. patent publication No. 2004/1904194.

There is a general desire for protective headgear and/or related apparatus for mitigating spinal cord injuries. By way of non-limiting example, such spinal cord injuries may include the type associated with axial compression and fracture of the spine resulting in deformation and injury to the spinal cord.

SUMMARY

One aspect of the present invention provides a helmet wearable on a user's head for mitigating neck injury. The helmet incorporates an outer member which defines a concavity; an inner member, at least a portion of which is located within the concavity; and a path-motion guide mechanism which couples the inner member to the outer member. The path-motion guide mechanism permits guided relative movement between the inner member and the outer member in response to an impact force. The guided relative movement is constrained to one or more predetermined paths and comprises, for each of the one or more predetermined paths, relative translation and/or rotation between the inner and outer members.

Another aspect of the present invention provides a method for mitigating neck injury. The method involves providing a helmet wearable on a head of a user, the helmet comprising: an outer member defining a concavity; and an inner member, at least a portion of which is located within the concavity. The method also involves facilitating guided relative movement between the inner member and the outer member in response to an impact force. Facilitating guided relative movement between the inner member and outer member comprises constraining the relative movement to one or more predetermined paths, wherein each of the one or more predetermined paths involves relative translation and/or rotation between the inner and outer members.

Further aspects and features of specific embodiments of the invention are described in more detail below.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of the invention provide methods and apparatus for mitigating neck injury. A helmet, wearable on a user's head comprises an outer member which defines a concavity; an inner member, at least a portion of which is located within the concavity; and a path-motion guide mechanism which couples the inner member to the outer member. The path-motion guide mechanism permits guided relative movement between the inner member and the outer member in response to an impact force. The guided relative movement is constrained to one or more predetermined paths and comprises, for each of the one or more predetermined paths, relative translation and/or rotation between the inner and outer members.

Figure 1:
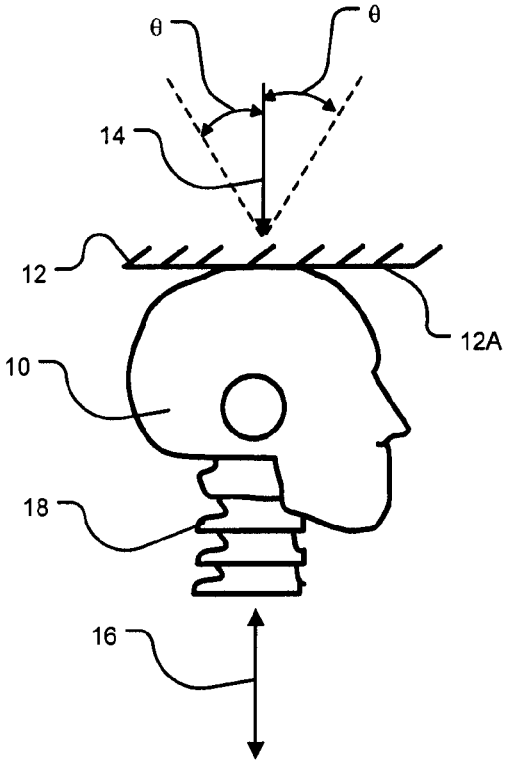
FIG. 1 is a schematic representation of a collision between an individual and an object that results in an impact force to the head.

The dynamics of axial compression type spine and spinal cord injuries have been studied and are illustrated schematically in FIG. 1. A common cause for axial compression injury is an impact force applied to the head (typically to a portion of the head referred to as the top of the head), where the applied force has a component which is at least partially aligned with the spine. Spinal cord injury can occur when components of the bony spine are forced into the spinal cord through fracture or dislocation. This circumstance is shown in FIG. 1, where an individual's head 10 collides with an object 12, such that an impact force 14 is applied to head 10 by object 12 and force 14 is generally aligned with axis 16 of spine 18. Because force 14 has at least a component in general alignment with axis 16 of spine 18, impact force 14 may be referred to as an axial crown force. As discussed in more detail below, force 14 may be transferred from head 10 to spine 18.

In general, force 14 need not be directly aligned with axis 16 of spine 18. Various researchers have demonstrated that forces within a cone having an angle θ within about 15° of spinal axis 16 tend to cause axial compression type injuries. However, it is expected that axial compression spinal cord injuries could well occur upon application of forces outside this 15° angular cone θ. The invention is not limited to forces in this angular region θ, nor is the invention specifically limited to axial compression type injuries. The invention has general application to circumstances where the spine 18 experiences any impact force having a component in the direction of axis 16. Such forces may all be referred to herein as axial crown forces.

In the schematic illustration of FIG. 1, it is assumed that the body (not shown) of an individual is moving such that their moving head 10 collides with stationary object 12 to generate force 14. According to some currently advocated theories, upon impact of head 10 against object 12, head 10 stops almost instantly and in the next few milliseconds, there is very little loading on neck 18 of the individual, as the individual's torso (not shown) and cervical vertebrae continue to move to the compliance of the intervertebral discs. If head 10 is unable to move, for example by flexion or extension, the cervical vertebrae will continue to be compressed by the torso. Force 14 is then transferred through immobile head 10 to spine 18 resulting in strain energy in spine 18 beyond its tolerable levels. This strain energy can result in compressive type injuries to one or more vertebrae and associated soft tissue injuries.

The assumption that moving head 10 collides with stationary object 12 to generate force 14 is not necessary. In some circumstances, force 14 may be generated by object 12 moving relative to head 10 and/or movement of both head 10 and object 12.

The mechanics of axial compressive cervical spine injuries suggest that it is possible to extend the traditional role of helmets and other protective headgear to protect against cervical compressive injuries in impacts of moderate energies without substantially compromising the headgear's efficacy in head protection. Particular embodiments of the invention described herein provide protective headgear for lowering the effective magnitude and/or increasing the effective duration of the initial deceleration of head 10. This may delay onset of an immediate load (i.e. force 14) on cervical spine 18. During this prolonged deceleration and/or reduced magnitude deceleration of head 10, head 10 may be guided to move along one or more paths, such that alignment between head 10 and spine 18 is modified to reduce the load experienced by cervical spine 18 (e.g. due to the incoming momentum of the torso and/or incoming momentum of object 12).

Figure 2:
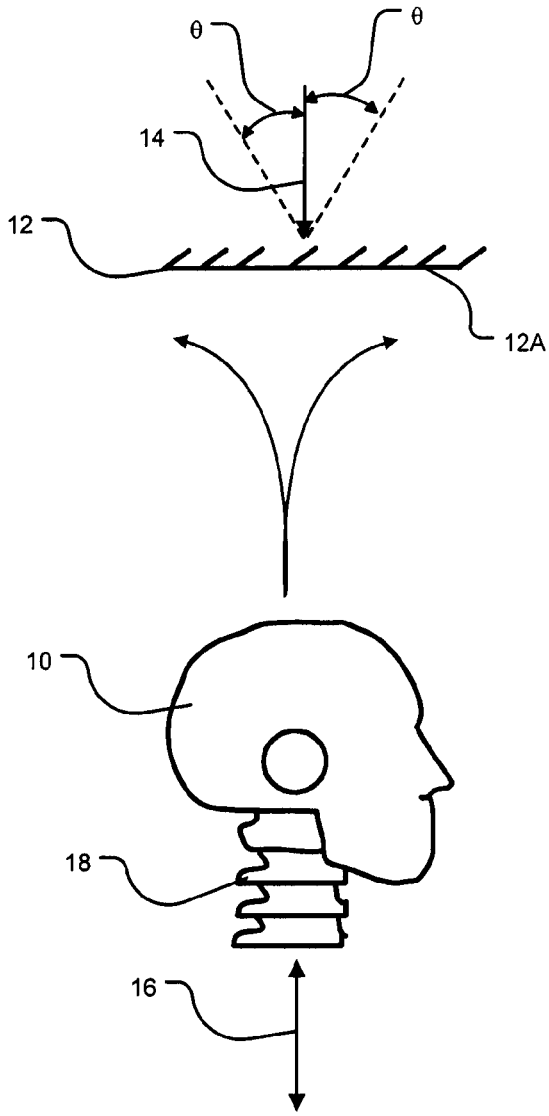
FIG. 2 is a schematic representation of guided motion which can mitigate spinal cord injuries resulting from an impact force to the head by causing extension or flexion of the neck.

In some embodiments, head 10 is guided with some component of motion along an impact surface 12A of object 12. Impact surface 12A may extend in a direction having at least a component orthogonal to spinal axis 16. A component of the relative impact velocity between head 10 and object 12 may be perpendicular to impact surface 12A. This situation is schematically illustrated in FIG. 2. By way of non-limiting example, guided motion of head 10 may be in one of the directions indicated by arrows 20A, 20B. Motion of head 10 in a direction along impact surface 12A may provide head 10 with inertia along this direction and as loading develops in neck 18, this inertia may "push" head 10 along impact surface 12A keeping head 10 moving. This contrasts with the situation where head 10 stops at impact before loading of neck 18 develops. Keeping head 10 in motion as loading of neck 18 develops helps to mitigate the loads that neck 18 is exposed to.

Figure 3A:
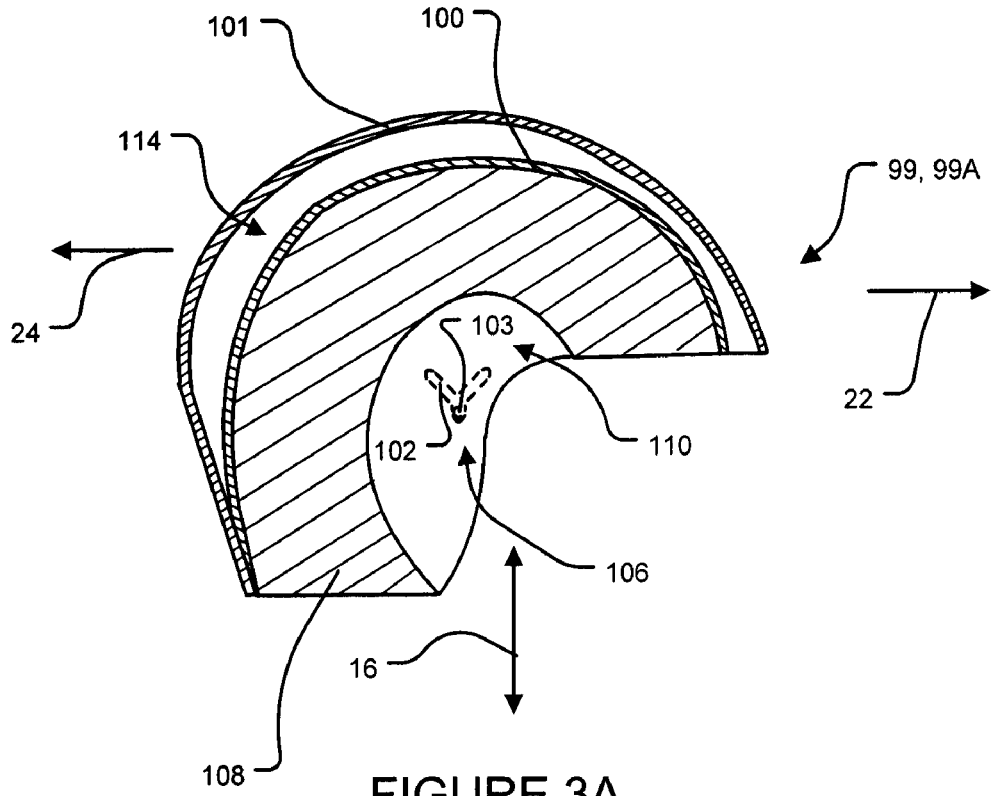
FIGS. 3A and 3B show protective headgear according to a particular embodiment of the invention.

FIG. 3A shows a schematic cross-sectional view of protective headgear 99 according to a particular embodiment of the invention. In the illustrated embodiment, headgear 99 is worn on (i.e. attached to) the head 10 of a user. In the illustrated embodiment, protective headgear 99 is provided in the form of a helmet 99A which is worn on (i.e. attached to) the head 10 of a user. In response to forces having components in axial direction 16, helmet 99A induces flexion of the neck with anterior (direction 22) translational motion of the head or extension of the neck with posterior (direction 24) translational motion of the head.

Helmet 99A comprises an inner member 100, and an outer member 101 movably connected to inner member 100 by a path-motion guide mechanism 106. In the illustrated embodiment, inner member 100 and outer member 101 are provided in the form of shells and may be referred to as inner shell 100 and outer shell 101. Shells 100, 101 may have a relatively thin cross-sectional thickness (e.g. on the order of 25 mm or less) and may be relatively rigid (i.e. non-deformable) in relation to other components of helmet 99A. Inner and outer shells 100, 101 may have the same cross-sectional thickness or different cross-sectional thicknesses. Inner and outer shells 100, 101 may conform generally to the shape of the head 10 of a user as is customary with prior art helmets. Shells 100, 101 may be fabricated from materials similar to those used for the outer shells of prior art helmets. Shells 100, 101 may be fabricated from the same materials or from different materials.

Helmet 99A may comprise a padding material 108. In the illustrated embodiment, padding material 108 is located on an interior of inner member 100. Padding material 108 may be similar to the padding provided on prior art helmets and may comprise a layer similar to the intermediate padding layer of prior art helmets and a layer similar to the comfort liner of prior art helmets. Padding material 108 may comprise foam materials for example and may have variable density. Padding material 108 may be fabricated from material(s) similar to the padding layers of prior art helmets. Inner member 100 and/or padding material 108 may be shaped to provide a cavity 110 for receiving the head of an individual. Helmet 99A may also comprise a retention strap, chin strap or other suitable device (not shown) for securing helmet 99A to an individual's head.

Helmet 99A comprises a path-motion guide mechanism 106. In the illustrated embodiment, path-motion guide mechanism 106 comprises a slot 102 which opens toward an interior surface of outer member 101 and a protrusion 103 which projects outwardly from an exterior surface of inner member 100 and is received in slot 102. Slot 102 may be formed integrally with outer member 101. Similarly, protrusion 103 may be integrally formed with inner member 100. This is not necessary. Slot 102 and protrusion 103 may be provided in separate piece(s) of material which may be located between inner and outer members 100, 101 and which may be respectively coupled to outer and inner members 101, 100.

Slot 102 guides the motion of protrusion 103, allowing protrusion 103 to move within slot 102 and constraining the motion of protrusion 103 to within slot 102. The constraint of the motion of protrusion 103 to within slot 102 permits corresponding relative motion between inner member 100 and outer member 101, while constraining the relative motion between inner member 100 and outer member 101.

The cross-sectional view of FIG. 3A shows only one path-motion guide mechanism 106 generally located on the left side of helmet 99A between inner and outer members 100, 101. Helmet 99A may comprise a corresponding path-motion guide mechanism 106' (not explicitly shown) on the right hand side of helmet 99A between inner and outer members 100, 101. Right hand side guide mechanism 106' may be complementary to and substantially similar to left hand side guide mechanism 106.

Figure 3B:
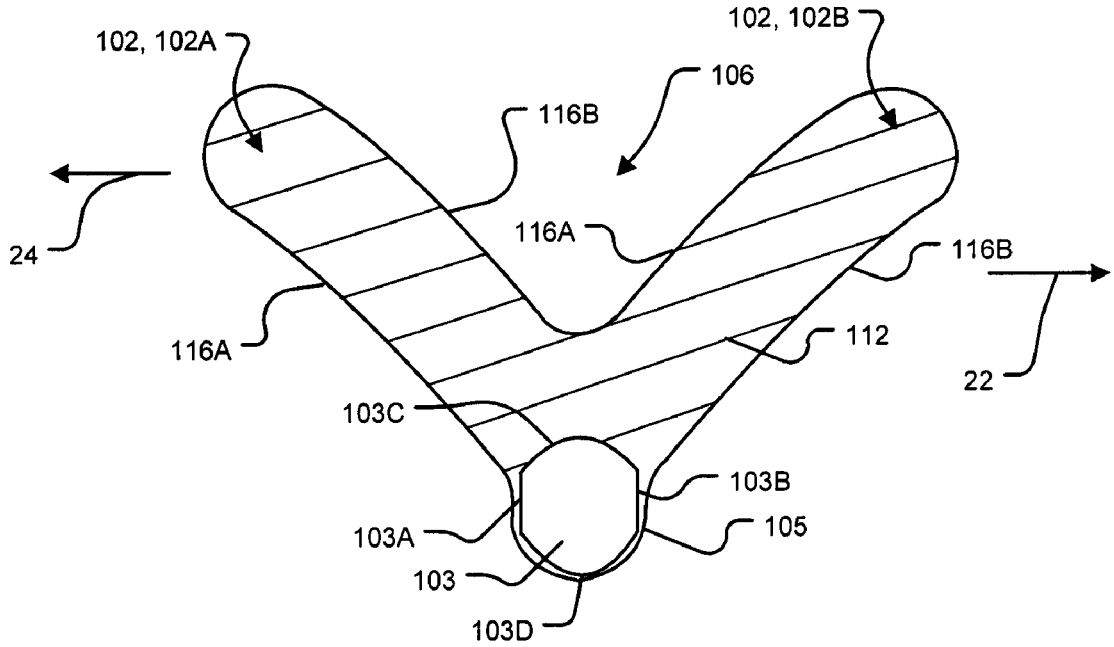

FIG. 3B schematically depicts path-motion guide mechanism 106 in more particular detail. Guide mechanism 106 shown in FIG. 3B represents one particular embodiment of the invention. In the illustrated view of FIG. 3B, guide mechanism 106 is in its home (i.e. non-deployed) configuration, wherein protrusion 103 is resting in a base portion 105 of slot 102. In addition to base portion 105, in the illustrated embodiment, slot 102 comprises a pair of branches, including a posterior branch 102A which extends in at least partially in posterior direction 24 and an anterior branch 102B which extends at least partially in an anterior direction 22. In the illustrated embodiment, branches 102A, 102B also extend away from base 105 (i.e. upwardly when helmet 99A is conventionally oriented). Together, base portion 105 and branches 102A, 102B provide slot 102 with a generally Y-shaped configuration.

Base portion 105 of slot 102 may be of varying shape which may depend on the dimensions of protrusion 103. For example, slot 102 may have a depth that is about 75%-90% of the length of protrusion 103. In the illustrated embodiment, protrusion 103 has a somewhat cylindrical shape. In cross-section, protrusion 103 comprises flattened sidewalls 103A, 103B and curved sidewalls 103C, 103D. Preferably, the dimension between curved sidewalls 103C, 103D is greater than the orthogonal dimension between flattened sidewalls 103A, 103B. This shape of protrusion 103 tends to prevent rotation of protrusion 103 within slot 102 (i.e. about an axis coming out of the page of FIG. 3B). As explained in more detail below, protrusion 103 may be provided with other cross-sectional shapes. In the illustrated embodiment of FIG. 3B, base portion 105 of slot 102 has a width which may be a range of about 100-125% of the width of protrusion 103 between flattened sidewalls 103A, 103B.

Branches 102A, 102B of slot 102 may be of approximately equivalent length and shape, although this is not necessary. The specific shape and length of branches 102A, 102B vary according to the range of relative motion desired between inner member 100 and outer member 101. A longer branch 102A, 102B may confer a greater range of relative motion between inner member 100 and outer member 101; similarly, a shorter branch 102A, 102B may confer a more limited range of relative motion between inner member 100 and outer member 101. The shape of the posterior branch 102A or anterior branch 102B of the slot may be determined experimentally and may be designed to suit a particular application, use of helmet 99A, individual preference or the like. The width of branches 102A, 102B may be in a range of about 100%-115% of the width of protrusion 103 between flattened sidewalls 103A, 103B. In the illustrated example, slot 102 is dimensioned to fit relatively snugly against protrusion 103 and protrusion 103 may slide against the walls of slot 102. Friction that may inhibit motion of protrusion 103 within slot 102 may be minimized by selection of appropriate material and surface finishing.

In some embodiments, portions of slot 102 may contain an energy-absorbing material 112 which may deform under the application of sufficient external force—e.g. force applied by protrusion 103 the event of an axial force 14. In the process of such deformation, energy-absorbing material 112 absorb some of the mechanical energy from protrusion 103. Energy-absorbing material 112 may exhibit plastic deformation under the application of sufficient external force (e.g. external force applied by protrusion 103 as it moves through slot 102 in response to an axial crown force of sufficient magnitude). Energy-absorbing material 112 may additionally or alternatively comprise structural features which allow it to absorb energy while deforming. By way of non-limiting example, energy-absorbing material 112 may comprise a lattice structure having variable density and/or frangible components. Energy-absorbing material 112 may be selected to exhibit a threshold yield point force prior to deforming. Energy-absorbing material 112 may comprise a crushable material, for example.

Energy-absorbing material 112 may be used in portions of slot 102 outside of base portion 105. Since energy-absorbing material 112 exhibits a threshold force prior to deformation, energy-absorbing material 112 may provide additional mechanical support to helmet 99A and may prevent undesirable motion of inner member 100 relative to outer member 101. By way of non-limiting example, energy-absorbing material 112 may reduce undesired motion or vibration of protrusion 103 within slot 102, and may reduce rattling or other noise close to the user's ear. Examples of such suitable energy-absorbing materials may include expanded polystyrene, aluminum honeycomb, cellular cardboard, or frangible structures made of ABS or polycarbonate plastic and the like.

Helmet 99A may be provided with an intermediate space 114 between inner member 100 and outer member 101. Intermediate space 114 may contain padding (not explicitly shown in FIG. 3A). Such intermediate padding may function in a manner similar to the intermediate padding layer of prior art helmets and may comprise any suitable material. By way of non-limiting example, such intermediate padding may comprise an energy-absorbing material. The intermediary padding may comprise a composite having a directional stiffness, such as glass fibre reinforced or carbon fibre reinforced composites, magnetohydrodynamic gel, a low density butyl rubber and the like. Preferably, the intermediate padding is shaped and/or located to avoid interfering with the relative movement between inner member 100 and outer member 101 as discussed in more detail below.

Intermediate space 114 may facilitate relative motion between inner member 100 and outer member 101. The relative movement between inner member 100 and outer member 101 may be constrained by the movement of protrusion 103 within slot 102. In the illustrated embodiment of FIGS. 3A and 3B, where slot 102 comprises the illustrated pair of branches 102A, 102B, relative movement between inner member 100 and outer member 101 may comprise translation of inner member 100 relative to outer member 101 in a direction which brings inner member 100 and outer member closer together and may also comprise relative movement between inner member 100 and outer member 101 in the anterior or posterior directions 22, 24 depending on whether protrusion 103 travels down branch 102B or branch 102A of slot 102. In some embodiments, a maximal range of anterior or posterior translation may be about 25 mm and a maximal range of inner and outer members 100, 101 toward one another may be about 20 mm. In other embodiments, these maximal translation ranges may be greater.

In addition to relative translation between inner member 100 and outer member 101, there may be relative rotation of inner member 100 and outer member 101 as protrusion 103 moves within slot 102. In the illustrated embodiment of FIGS. 3A and 3B, such relative rotation may be about one or more axes that project into and out of the drawing page—i.e. the axes of relative rotation will move in the plane of the drawing page as protrusion 103 moves along slot 102. In some embodiments, such relative rotation is guided by the movement of protrusion 103 within slot 102. For example, in the illustrated embodiment of FIG. 3B, protrusion 103 may be wider between curved sidewalls 103C, 103D than it is between flattened sidewalls 103A, 103B, such that protrusion 103 only fits within the slot-defining edges 116A, 116B of branches 102A, 102B when flattened sidewalls 103A, 103B are adjacent respective slot-defining edges 116A, 116B. In such embodiments, slot-defining edges 116A, 116B of branches 102A, 102B prevent protrusion 103 from rotating within branches 102A, 120B, except as guided by slot-defining edges 116A, 116B. Because branches 102A, 102B of slot 102 are curved, when protrusion 103 moves along branches 102A, 102B, the orientation of protrusion 103 rotates about axes that project into and out of the FIG. 3B drawing page. This change in the orientation of protrusion 103 is accompanied by corresponding relative rotation of inner member 100 and outer member 101.

Figure 4A:
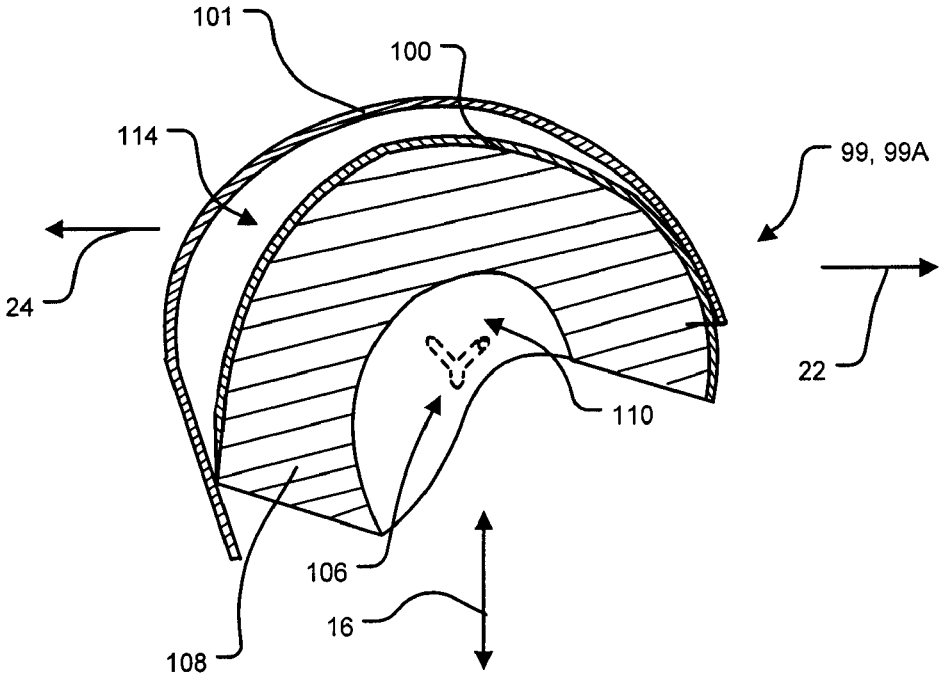
FIGS. 4A and 4B show the FIGS. 3A, 3B protective headgear when the protrusion has moved along the anterior branch of the slot.
Figure 4B:
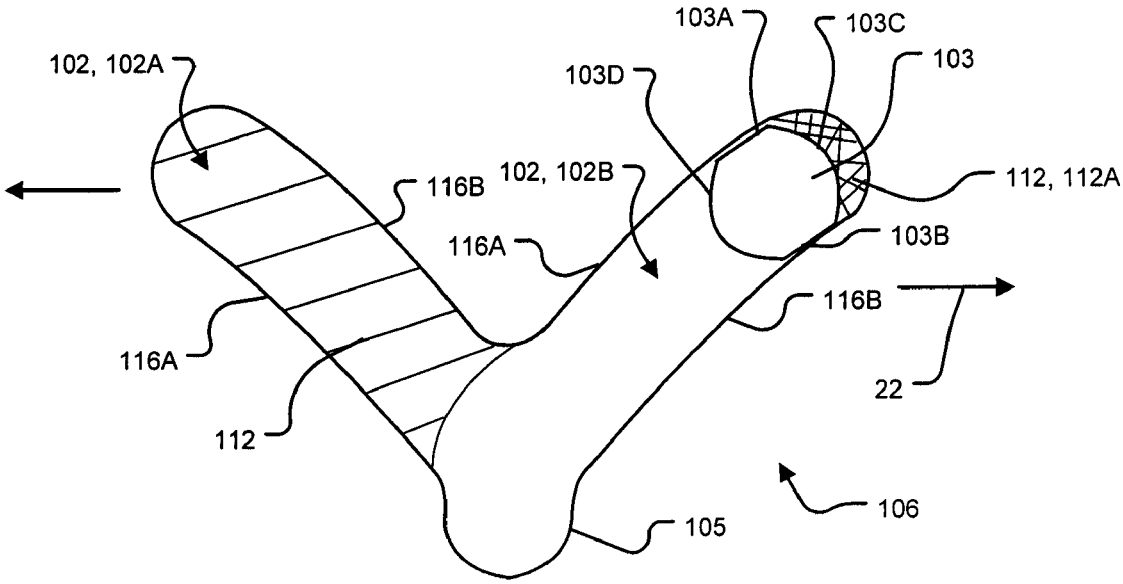

FIGS. 4A and 4B schematically depict a particular response of helmet 99A to an axial crown force wherein protrusion 103 is guided to move along anterior branch 102B of slot 102. It can be seen from FIG. 4B, that energy-absorbing material 112 in anterior branch 102B has been compressed by the motion of protrusion 103 in branch 102B to become compressed material 112A. With this guided movement of protrusion 103, inner member 100 moves in an anterior direction 22 with respect of outer member 101 and, in the illustrated view, inner member 100 rotates in the clockwise direction with respect to outer member 101. The movement of inner member 100 relative to outer member 101 in the anterior direction 22 together with the clockwise rotation of inner member 100 relative to outer member 101 causes translation of the user's head (located inside head-receiving cavity 110) in anterior direction 22 and flexion of the user's neck.

Figure 5A:
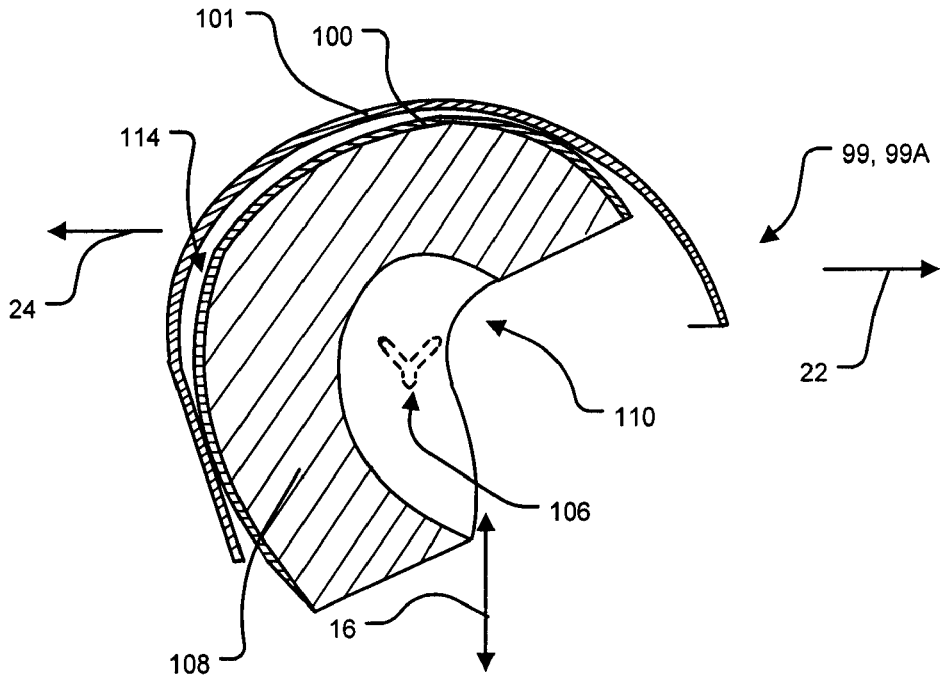
FIGS. 5A and 5B shown the FIGS. 3A, 3B protective headgear when the protrusion has moved along the posterior branch of the slot.
Figure 5B:
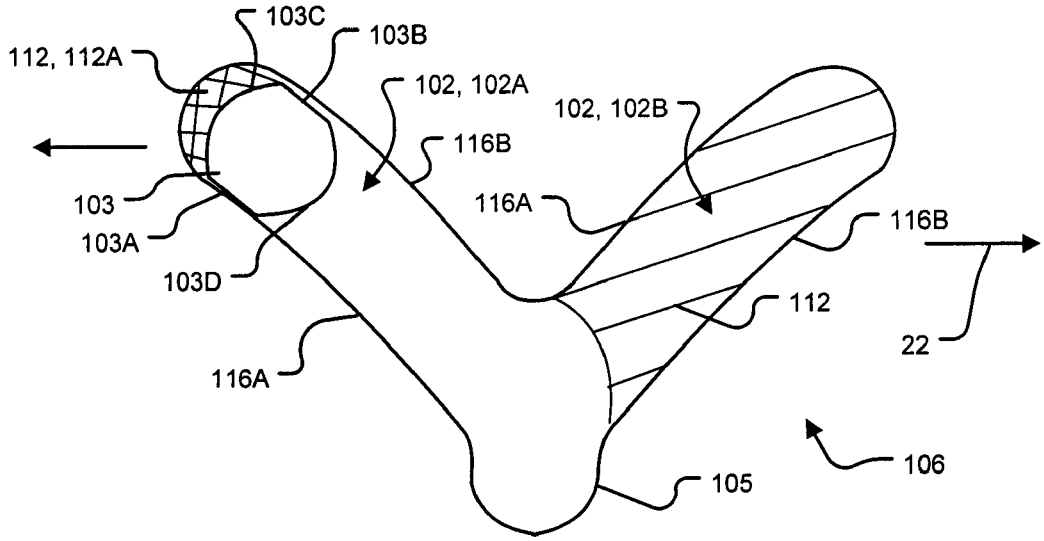

FIGS. 5A and 5B schematically depict a particular response of helmet 99A to an axial crown force wherein protrusion 103 is guided to move along posterior branch 102A of slot 102. It can be seen from FIG. 5B, that energy-absorbing material 112 in posterior branch 102A has been compressed by the motion of protrusion 103 in branch 102A to become compressed material 112A. With this guided movement of protrusion 103, inner member 100 moves in an posterior direction 24 with respect of outer member 101 and, in the illustrated view, inner member 100 rotates in the counterclockwise direction with respect to outer member 101. The movement of inner member 100 relative to outer member 101 in the posterior direction 24 together with the counterclockwise rotation of inner member 100 relative to outer member 101 causes translation of the user's head (located inside head-receiving cavity 110) in posterior direction 24 and extension of the user's neck.

In the illustrated embodiment shown in FIGS. 4A, 4B, 5A and 5B, path-motion guide mechanism 106 may facilitate guide motion of protrusion 103 in slot 102 down either one of branches 102A, 102B in response to axial crown force.

Figure 6A:
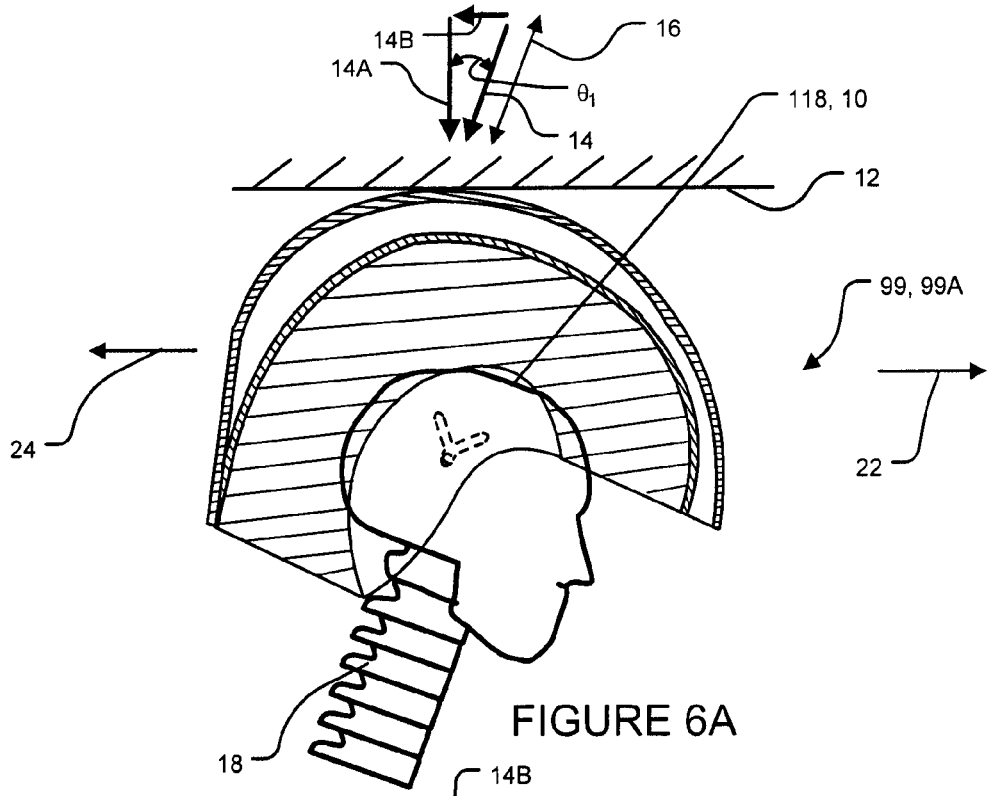
FIGS. 6A and 6B respectively schematically depict circumstances where it is desirable for protrusion to move along anterior branch and posterior branch of the slot.

FIG. 6A shows a scenario where an axial crown force 14 is applied to a user wearing helmet 99A. In the FIG. 6A illustration, axial crown force 14 is applied in the direction shown by arrow 14. Axial crown force 14 comprises a component 14A in a direction normal to surface 12 and a component 14B in a direction tangential to surface 12. By way of non-limiting example, this circumstance may arise because the user's body is traveling in the opposite direction of axial crown force 14 when it impacts surface 12. In the FIG. 6A illustration, axial crown force 14 is applied at a location posterior to crown 118 of head 10. By way of non-limiting example, this circumstance may arise because of the orientation of the user's body when helmet 99A contacts object 12. Assuming that the magnitude of axial crown force 14 is sufficient, it is desirable, in the circumstance of FIG. 6A, for inner member 100 to move relative to outer member 101 in the manner shown in FIGS. 4A and 4B. That is, it is desirable for protrusion 103 to move along anterior branch 102B.

The circumstances of FIG. 6A merely represent one circumstance where it is desirable for protrusion 103 to move along anterior branch 102B. There may be other circumstances where it is desirable for protrusion 103 to move along anterior branch 102B depending, for example, on the direction and location of axial crown force 14 relative to head 10, spine 18 and spinal axis 16 of the user. It may be desirable for protrusion 103 to move along anterior branch 102B in any circumstance where any combination of flexion of spine 18 and/or anterior motion of head 10 will prevent or mitigate neck injury by maintaining the forces experienced by the user's neck lower than the tolerance of the user's neck to injury. By way of non-limiting example, it may also desirable for protrusion 103 to move along anterior branch 102B under circumstances where spine 18 is partially flexed at the time of impact. The angle $\theta_1$ shown in FIG. 6A between axial crown force 14 and the normal 14A to surface 12 may range from about 0-80°, for example.

Figure 6B:
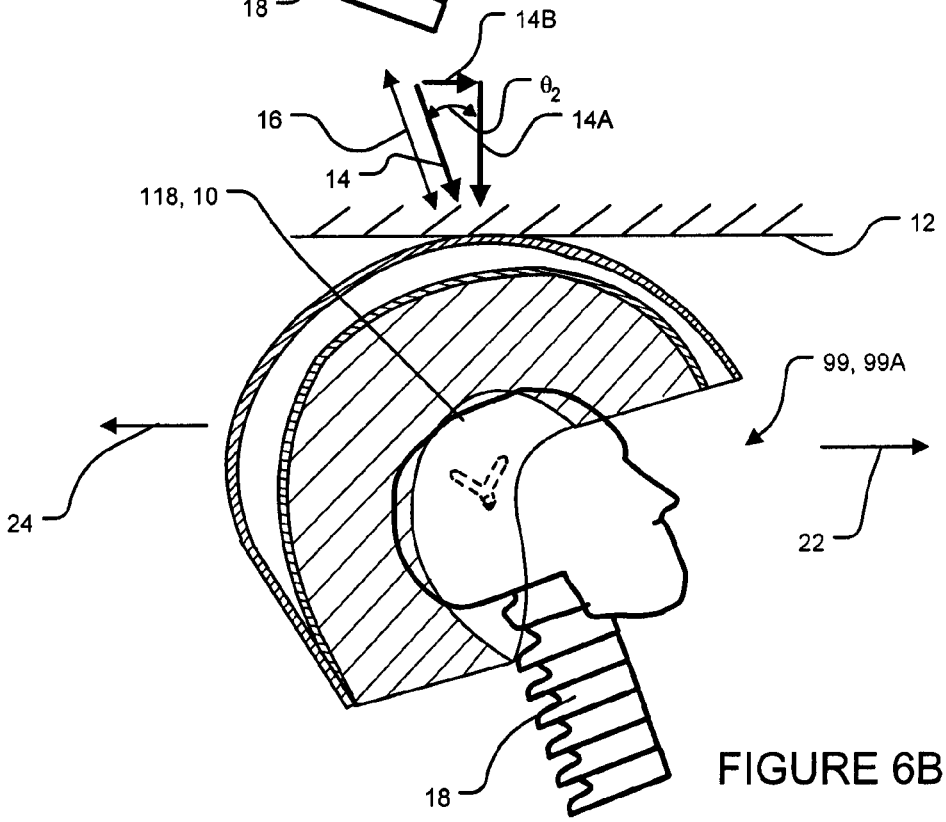

FIG. 6B shows a scenario where an axial crown force 14 is applied to a user wearing helmet 99A. In the FIG. 6B illustration, axial crown force 14 is applied in the direction shown by arrow 14 and at a location anterior to crown 118 of head 10. Axial crown force 14 comprises a component 14A in a direction normal to surface 12 and a component 14B in a direction tangential to surface 12. Assuming that the magnitude of axial crown force 14 is sufficient, it is desirable, in the circumstance of FIG. 6B, for inner member 100 to move relative to outer member 101 in the manner shown in FIGS. 5A and 5B. That is, it is desirable for protrusion 103 to move along posterior branch 102A.

The circumstances of FIG. 6B merely represent one circumstance where it is desirable for protrusion 103 to move along posterior branch 102A. There may be other circumstances where it is desirable for protrusion 103 to move along posterior branch 102A depending, for example, on the direction and location of axial crown force 14 relative to head 10, spine 18 and spinal axis 16 of the user. It may be desirable for protrusion 103 to move along posterior branch 102A in any circumstance where any combination of extension of spine 18 and/or posterior motion of head 10 will prevent or mitigate neck injury by maintaining the forces experienced by the user's neck lower than the tolerance of the user's neck to injury. By way of non-limiting example, it may also desirable for protrusion 103 to move along posterior branch 102A under circumstances where spine 18 is partially extended at the time of impact. The angle $\theta_2$ shown in FIG. 6B between force 14 and the normal 14A to surface 12 may range from about 0-80°, for example.

Figure 7A:
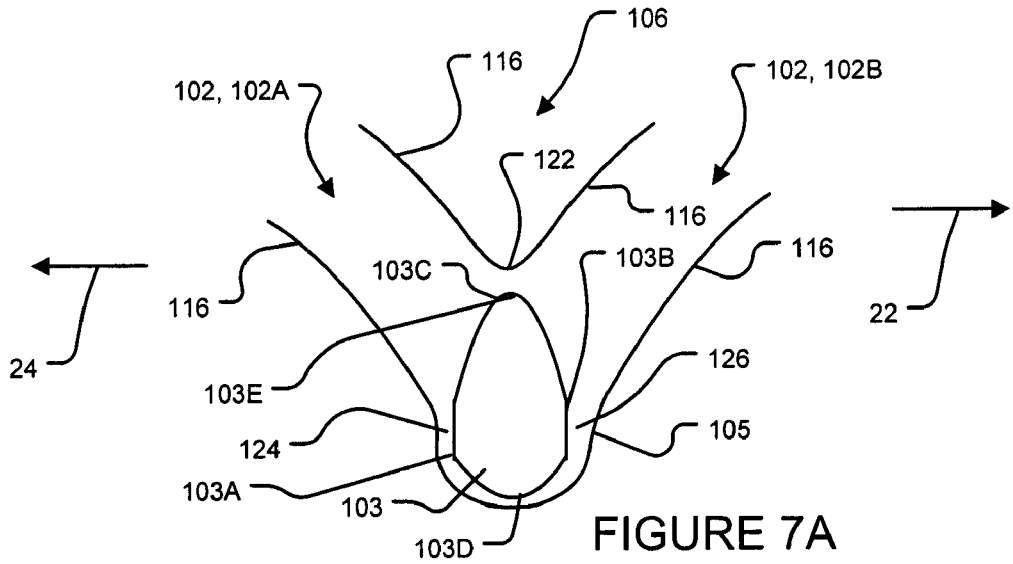
FIGS. 7A-7C schematically depict feature of the path-motion guide mechanism which may be useful to select between the posterior and anterior branch of the slot according to a particular embodiment of the invention.
Figure 7B:
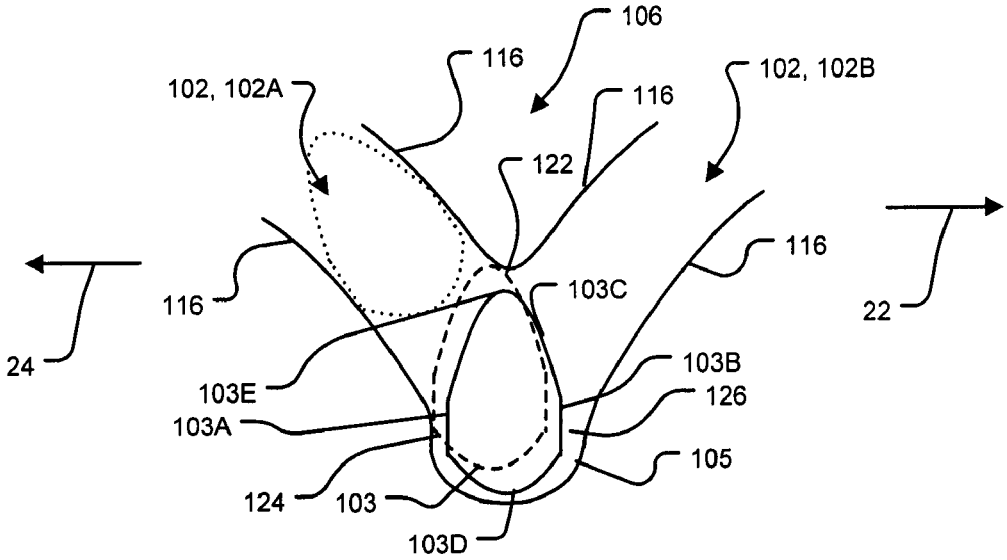
Figure 7C:
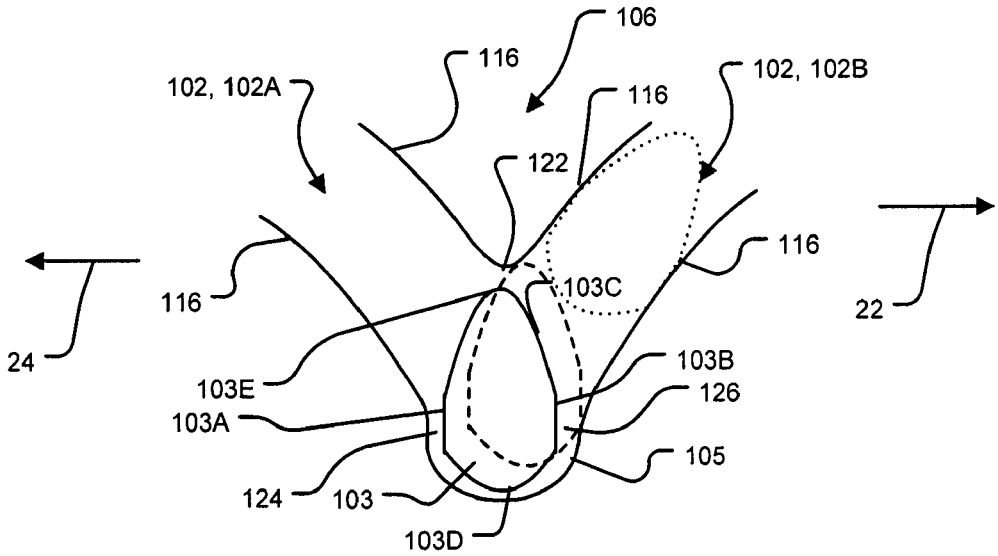

Path-motion guide mechanism 106 may incorporate features to help select between motion down anterior branch 102B or posterior branch 102A based on the direction, magnitude and location of axial crown force 14 relative to head 10, spine 16 and spinal axis 18 of the user. FIGS. 7A, 7B and 7C are schematic depictions of a portion of protrusion 103 and slot 102 according to a particular embodiment of the invention which show features of protrusion 103 and slot 102 which may be used to select between paths 102A, 102B.

FIG. 7A shows an embodiment where curved sidewall 103C of protrusion 103 is relatively pointed (compared to the other sidewalls 103A, 103B, 103C) and comes to an apex at 103E. In the illustrated embodiment, curved sidewall 103C has a relatively small radius of curvature in a region of apex 103E and a relatively large radius of curvature in regions spaced apart from apex 103E. In some embodiments, sidewall 103C may be angularly pointed (i.e. rather than curved).

In the FIG. 7A embodiment, slot-defining edges 116 are shaped to provide a relatively pointed apex 122 in a direction opposing apex 103E of protrusion 103. Apex 22 may be shaped such that slot-defining edges 116 have a relatively small radius of curvature in a region of apex 122 and a relatively large radius of curvature in regions spaced apart from apex 122. In some embodiments, slot-defining edges 116 may be angularly pointed (i.e. rather than curved).

Also in the FIG. 7A embodiment, it can be seen that base portion 105 of slot 102 is shaped to provide base portion 105 with a width that is greater than the width (between sidewalls 103A, 103B) of protrusion 103. In some embodiments, base portion 105 of slot 102 has a width which may be a range of about 101-125% of the width of protrusion 103 between flattened sidewalls 103A, 103B. Prior to movement of protrusion 103, protrusion 103 may be located generally centrally within base portion 105 to provide regions 124, 126 within base portion 105 of slot 102 on the posterior and anterior sides of protrusion 103. Regions 124, 126 may contain energy-absorbing material 112 similar to that discussed above.

In some circumstances, the direction and location of axial crown force 14 relative to head 10, spine 16 and spinal axis 18 of the user will be such that there is component of relative velocity between head 10 and object 12 which causes head 10 to move in posterior direction 24 relative to object 12. This relative velocity of head 10 and object 12 may result in a corresponding relative velocity in posterior direction 24 between protrusion 103 (attached to head 10 through inner member 100) and slot 102 (attached to (or part of) outer member 101 which stops upon impact with object 12). This situation is illustrated in FIG. 7B. In this circumstance, the component of velocity of protrusion 103 in posterior direction 24 relative to slot 102 causes protrusion 103 to move in posterior direction 24 when protrusion 103 is still located (at least partially) in base portion 105. Typically, protrusion 103 will also be moving relative to slot 102 in such a manner as to move inner member 100 and outer member 101 closer together. This combined relative movement of protrusion 103 and slot 102 is shown in dashed lines in FIG. 7B.

When protrusion 103 moves to the location of shown in dashed lines in FIG. 7B, apex 103E of protrusion 103 is located posteriorly relative to apex 122 of slot-defining edges 116. With this relative position of apex 103E of protrusion 103 and apex 122 of slot-defining edges 116, as protrusion 103 continues to move in this direction, protrusion 103 will be guided by interaction of sidewall 103C and slot-defining edges 116 to move along posterior branch 102A of slot 102. The movement of protrusion 103 along posterior branch 102A is shown in dotted lines in FIG. 7B.

In some circumstances, the direction and location of axial crown force 14 relative to head 10, spine 16 and spinal axis 18 of the user will be such that there is component of relative velocity between head 10 and object 12 which causes head 10 to move in anterior direction 22 relative to object 12. This relative velocity of head 10 and object 12 may result in a corresponding relative velocity in anterior direction 22 between protrusion 103 and slot 102. This situation is illustrated in FIG. 7C. In this circumstance, the component of velocity of protrusion 103 in anterior direction 22 relative to slot 102 causes protrusion 103 to move in anterior direction 22 when protrusion 103 is still located (at least partially) in base portion 105. Typically, protrusion 103 will also be moving relative to slot 102 in such a manner as to move inner member 100 and outer member 101 closer together. This combined relative movement of protrusion 103 and slot 102 is shown in dashed lines in FIG. 7C.

When protrusion 103 moves to the location shown in dashed lines in FIG. 7C, apex 103E of protrusion 103 is located anteriorly relative to apex 122 of slot-defining edges 116. With this relative position of apex 103E of protrusion 103 and apex 122 of slot-defining edges 116, as protrusion 103 continues to move relative to slot 102, protrusion 103 will be guided by interaction of sidewall 103C and slot-defining edges 116 to move along anterior branch 102B of slot 102. The movement of protrusion 103 along anterior branch 102B is shown in dotted lines in FIG. 7C.

In the embodiments described above, slot 102 contains energy-absorbing material 112. Energy-absorbing material 112 is optional. As discussed above, when present, energy-absorbing material 112 may function to provide additional mechanical support to helmet 99A by preventing undesirable motion of inner member 100 relative to outer member 101. By way of non-limiting example, energy-absorbing material 112 may prevent undesired movement of protrusion 103 within slot 102. For example, it may be undesirable for protrusion 103 to move within slot 102 unless there is a sufficient (i.e. threshold) axial crown force 14.

Figure 8A:
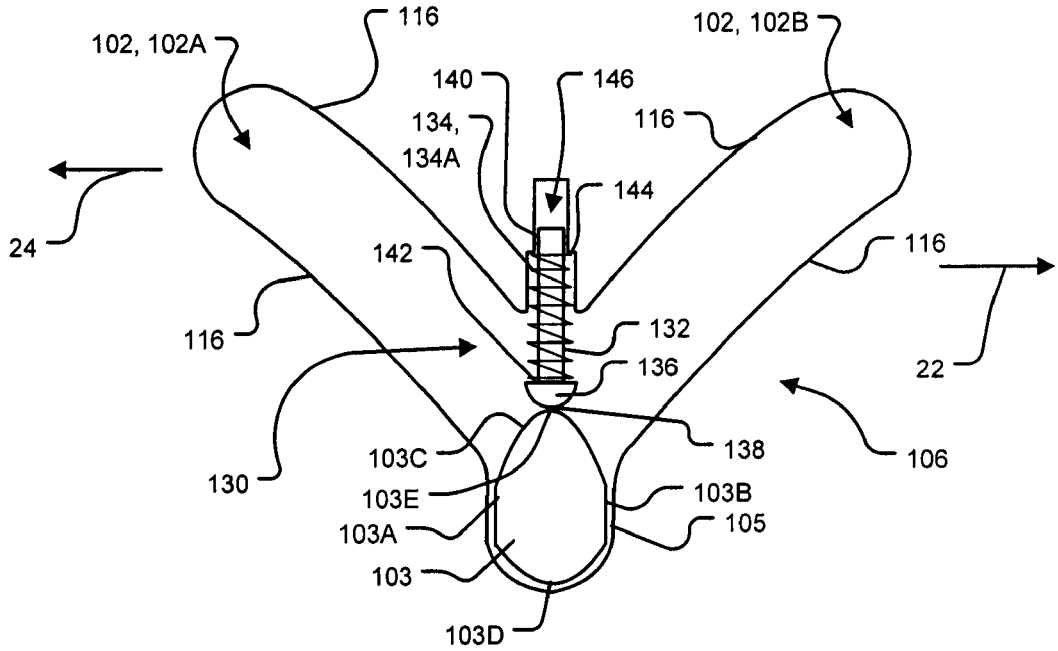
FIGS. 8A-8C show various components of a deployment mechanism according to a particular embodiment of the invention.
Figure 8B:
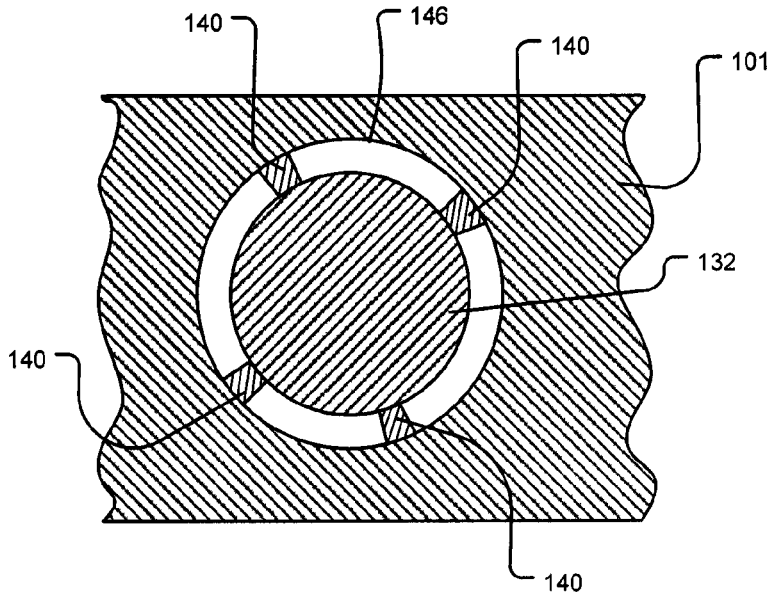
Figure 8C:
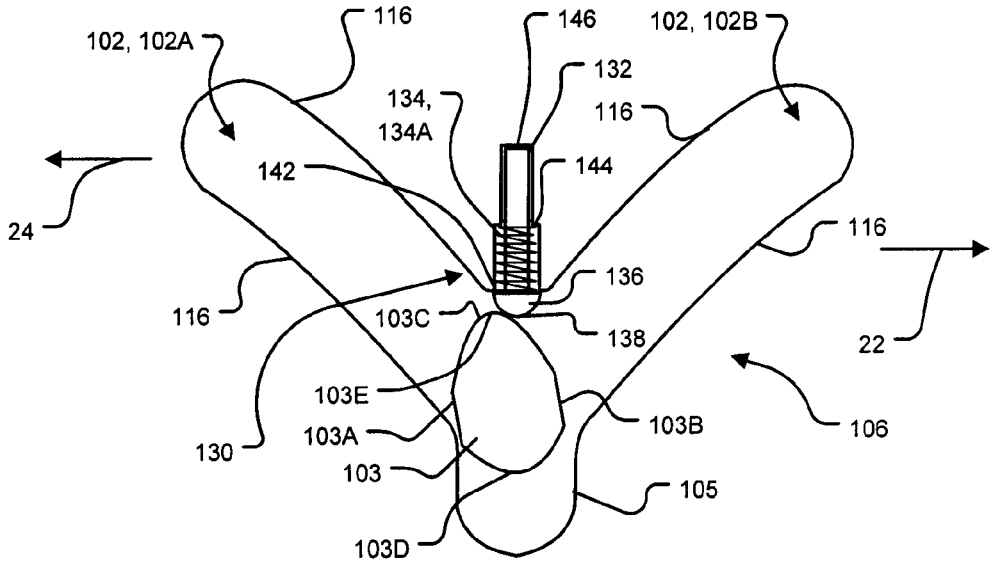

In addition to or as an alternative to energy-absorbing material 112, the function of preventing undesired movement of protrusion 103 with respect to slot 102 may be provided by an optional deployment mechanism. FIGS. 8A, 8B and 8C show various components of a deployment mechanism 130 according to a particular embodiment of the invention. In the FIGS. 8A-8C embodiment, deployment mechanism 130 comprises a piston 132 and a bias mechanism 134. Piston 132 may comprise a piston cap 136. Piston cap 136 may have an apex 138 which opposes apex 103E of protrusion 103 and which may interact with apex 103E of protrusion 103 in a manner similar to apex 122 discussed above. In the illustrated embodiment of FIGS. 8A-8C, bias mechanism 134 comprises a spring 134A. By way of non-limiting example, spring 134A may be fabricated from a deformable material, such as metal, elastomeric polymer or the like. Deployment mechanism 130 may also comprise one or more optional breakaway member(s) 140.

As shown in FIG. 8A, piston cap 136 may abut against sidewall 103C of protrusion 103. Bias mechanism 134 causes piston 132 and piston cap 136 to exert retaining force on protrusion 103 which tends to retain protrusion 103 in base portion 105 of slot 102. In the FIGS. 8A-8C embodiment, spring 134A of bias mechanism 134 is disposed between a shoulder 142 of piston cap 136 and the shoulders 144 of piston chamber 146. In other embodiments, spring 134A may be disposed in other locations, such as within piston chamber 146, for example. The amount of retaining force exerted by spring 134A may be controlled by pre-loading spring 134A. Increasing the preload of spring 134A causes a corresponding increased in the retaining force acting on protrusion 103 and may also increase the threshold force required for deployment (i.e. movement of protrusion 103 out of base portion 105 and into one of branches 102A, 102B).

If present, breakaway member(s) 140 may also help to retain protrusion 103 in base portion 105. In the illustrated embodiment of FIGS. 8A-8C, deployment mechanism 130 comprises a plurality of breakaway members 140 attached between a shaft of piston 132 and the walls of piston chamber 146. When breakaway members 140 are attached in this manner, they prevent movement of piston 132 into piston chamber 146 and thereby act to retain protrusion 103 in base portion 105. Under axial crown force 14 above a breakaway threshold, breakaway members 140 break, allowing piston 132 to be displaced into piston chamber 146 against the retention force of bias mechanism 134. In embodiments with breakaway member(s) 140, the preloading of bias mechanism 134 may be different than in embodiments without breakaway member(s) 140.

FIG. 8B shows a plan view of a plurality of breakaway members 140 according to a particular embodiment of the invention. In the FIG. 8B embodiment, piston chamber 146 is located in outer member 101, although this is not necessary. Breakaway members 140 attach to the interior surface of piston chamber 146 and to the exterior surface of piston 132. The illustrated embodiment includes four breakaway members 140, although, in general, any number of breakaway members 140 could be used. Breakaway members 140 may contribute (together with bias mechanism 134) to the threshold force required for deployment (i.e. movement of protrusion 103 down one of branches 102A, 102B. The contribution of breakaway members 140 to this threshold force will generally depend on their number, arrangement, dimensions and material. In particular embodiments, breakaway members 140 may be constructed of any of a variety of materials, including, by way of non-limiting example, plastics, high density polyethylene, aluminum, mild steel and other materials or combinations of materials. As discussed above, breakaway members 140 are optional.

FIG. 8C depicts the FIG. 8A path-motion guide mechanism 106 and deployment mechanism 130 just after deployment resulting from an axial crown force 14 applied to helmet 99A. In the illustration of FIG. 8C, the applied axial crown force 14 is sufficiently high to overcome a threshold deployment force provided by deployment mechanism 130. In the illustrated embodiment, the threshold deployment force of deployment mechanism 130 is provided by the combination of bias mechanism 134 and breakaway members 140. As discussed above, in some embodiments, slot 102 may contain an energy absorbing material 112 which may also contribute to the threshold deployment force.

When the applied axial crown force 14 is sufficiently high to overcome the threshold deployment force, protrusion 103 starts to move, breaking breakaway members 140 and moving piston 132 into piston chamber 146 against bias mechanism 134. In the FIG. 8C embodiment, this movement of protrusion 103 involves compressing spring 134A. As discussed above, upon application of axial crown force 14, protrusion 103 may have a velocity component in anterior direction 22 or posterior direction 24 relative to slot 102. This velocity component together with the shapes of piston cap 136 and sidewall 103C will dictate the branch 102A or 102B down which protrusion 103 moves. In the FIG. 8C, protrusion 103 has a relative velocity component in posterior direction 24, which causes apex 103E of sidewall 103C to be located posteriorly with respect to apex 138 of piston cap 136. When apex 103E is posterior to apex 138, the interaction of sidewall 103C and piston cap 136 causes protrusion to move down posterior branch 102A. It will be appreciated that if protrusion 103 had a relative velocity component in anterior direction 22 upon application of axial crown force, then protrusion 103 would travel down anterior branch 102B.

Figure 9:
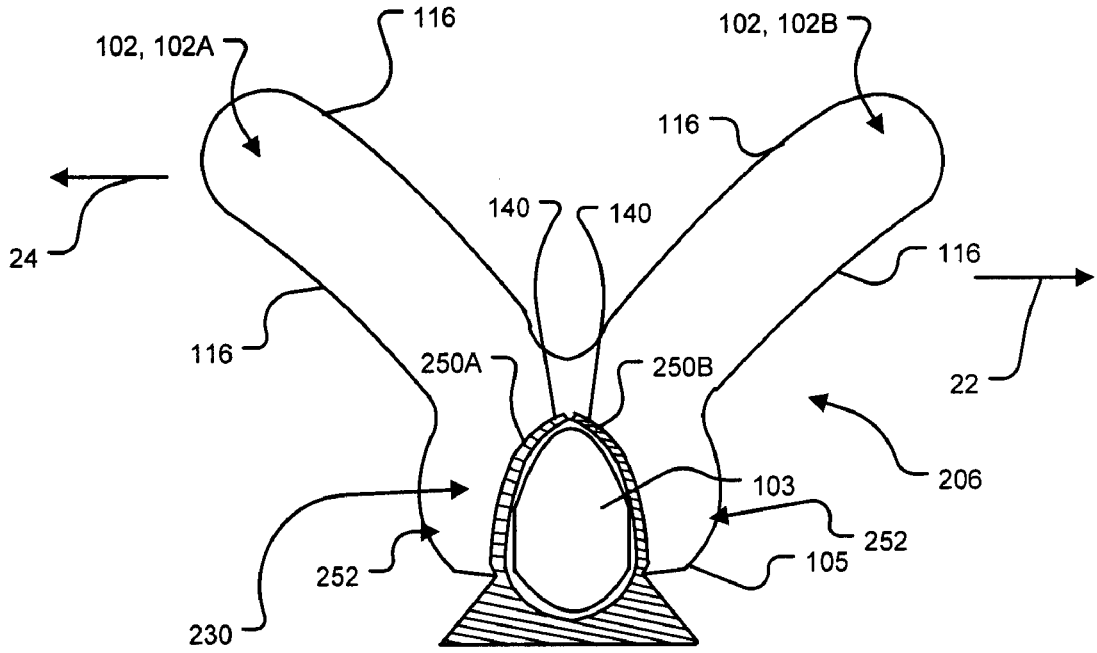
FIGS. 9 and 10 show deployment mechanisms according to other embodiments of the invention.

Another embodiment of a path-motion guide mechanism 206 and a corresponding deployment mechanism 230 is shown in FIG. 9. Many features of path-motion guide 206 are similar to those of path motion guide 106 described above and are provided with similar reference numbers. Deployment mechanism 230 differs from deployment mechanism 130. Deployment mechanism 230 comprises a pair of breakaway members 140 in the form of arms 250A, 250B (together arms 250), which act to restrain protrusion 103 in base portion 105 of slot 102 and provide the threshold deployment force. Breakaway arms 250 may be constructed from thermoplastic or thermoset plastic, aluminium, steel or other appropriate materials, for example. Slot 102 may be modified to allow for recessed regions 252 for receiving breakaway arms 250 upon deployment.

Figure 10:
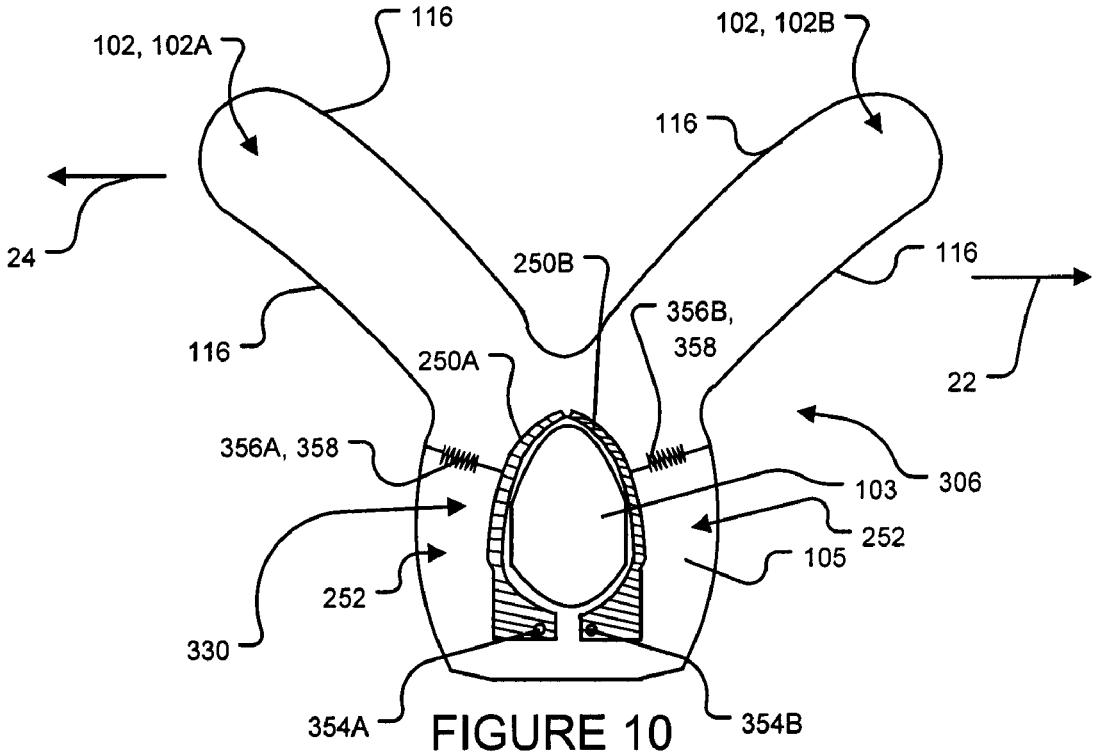

Another embodiment of a path-motion guide mechanism 306 and a corresponding deployment mechanism 330 is shown in FIG. 10. Many features of path-motion guide 306 are similar to those of path motion guide 106 described above and are provided with similar reference numbers. Deployment mechanism 306 is similar to deployment mechanism 206 and comprises arms 250 and recessed regions 252 for receiving arms 250. Arms 250 of deployment mechanism 306 are hinged at pivot joints 354A, 354B (together, pivot joints 354) and each arm 250A, 250B is supported by a corresponding bias mechanism 356A, 356B (together, bias mechanisms 356). In the illustrated embodiment, bias mechanisms 356 comprise springs 358, although other bias mechanisms may be used in the place of springs 358.

Arms 250, bias mechanisms 356 and hinges 354 cooperate to retain protrusion 103 in base portion 105 of slot 102 and to provide the threshold deployment force. Under the influence of an axial crown force 14 of sufficient magnitude, protrusion 103 will be provided some momentum in anterior direction 22 or posterior direction 24. This momentum will cause one of bias mechanisms 356A, 356B to allow its corresponding arm 250A, 250B to open wider than the other one of arms 250A, 250B. Protrusion 103 will be directed by arms 250A, 250B into the branch 102A, 102B corresponding to the arm 250A, 250B which is open wider. In this manner, deployment mechanism 330 can be used to help select the branch 102A, 102B along which protrusion 103 moves under axial crown force 14.

In other embodiments, bias mechanisms 356 may comprise other force providing devices. In some embodiments, bias mechanisms 356 may comprise one or more suitably configured actuators. Such actuators may be electronically controllable, for example.

Figure 11:
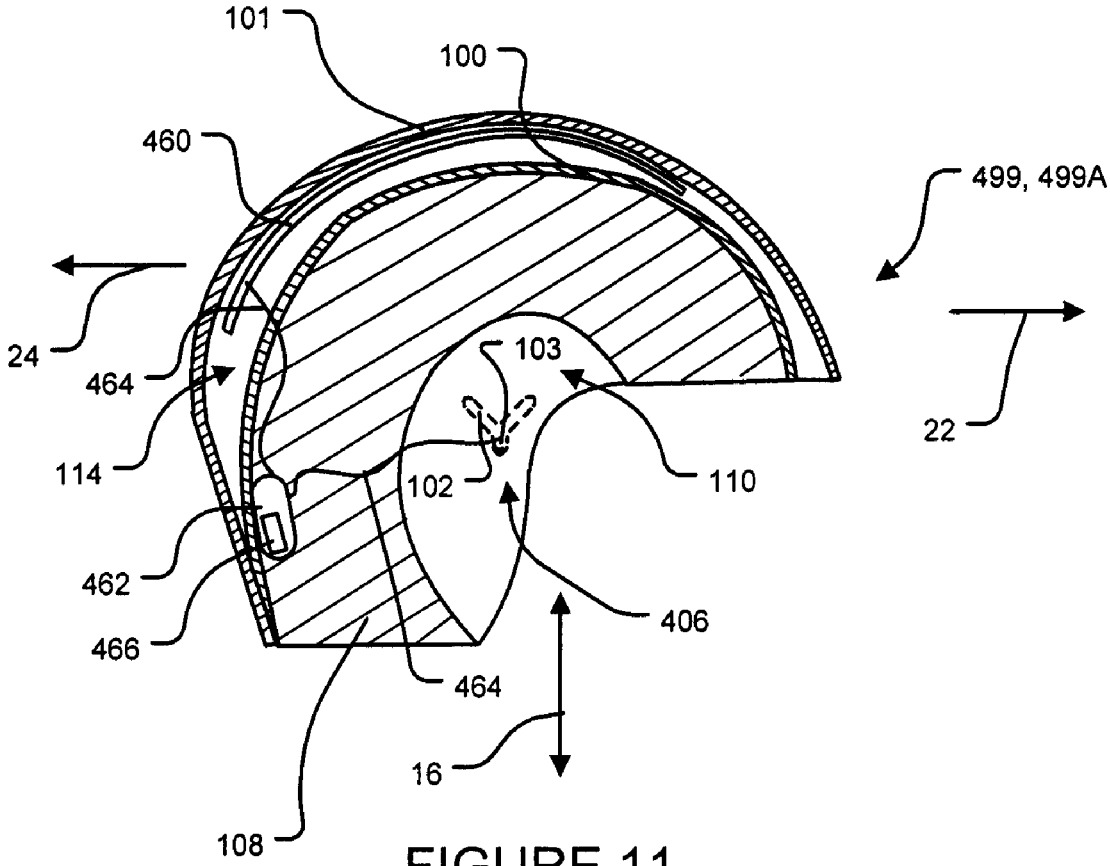
FIG. 11 shows protective headgear according to another embodiment of the invention.

FIG. 11 depicts a protective headgear 499 according to another embodiment. In the FIG. 11 embodiment, headgear 499 comprises a helmet 499A. Helmet 499A incorporates many features similar to those of helmet 99A described above. Features of helmet 499A which are similar to those of helmet 99A are provided with similar reference numbers. Although not specifically illustrated in FIG. 11, helmet 499A incorporates a path guide mechanism 406 which is similar in many respects to path-motion guide mechanism 306 (FIG. 10), except that bias mechanisms 356 comprise electronically controllable actuators. Such actuators may generally comprise any suitable type of actuator, such electromechanical actuators or explosive actuators (e.g. air bags), for example.

Helmet 499A comprises a sensor 460, which may sense force and/or pressure. In the illustrated embodiment, sensor 460 comprises an array of piezoelectric sensors, although one or more other suitable sensors may be used in the place of the piezoelectric sensor array. Sensor 460 may be located between inner member 100 and outer member 101, although sensor 460 may be provided in other locations. Sensor 460 detects the location and orientation of force and/or pressure experienced by helmet 499A.

Hemet 499A may also comprise a housing 462 for housing power and/or control electronic 466. In the illustrated embodiment, housing 462 is located on an interior of inner member 100, although housing 462 may be provided in other suitable locations. Suitable electrical connections 464 may be provided between sensor 460, housing 462 and the actuators of bias mechanisms 356.

Control electronics 466 may receive sensor data from sensor 460 and may be programmed or otherwise configured to interpret the sensor data to determine the location and orientation of forces (or pressure) experienced by helmet 499A. Control electronics 466 may then send a suitable signal to one or both of the actuators of bias mechanisms 356. Control electronics 466 may actuate one of bias mechanisms 356A, 356B, such that one of arms 250A, 250B opens more than the other one of arms 250A, 250B. In this manner, control electronics 466 may select the branch 102A, 102B along which protrusion 103 moves.

In some embodiments, the path-motion guide mechanisms described herein are resettable. For example, path-motion guide mechanisms incorporating hinged arms 250 (e.g. deployment mechanism 330 of FIG. 10) may be reset by resetting arms 250 and bias mechanisms 356. In path-motion guide mechanisms incorporating piston-based deployment mechanisms (similar to deployment mechanism 130 of FIGS. 8A-8C), bias mechanism 134 may be reset, provided that the deployment mechanism does not incorporate breakaway members 140.

In some embodiments, the path-motion guide mechanisms described herein are removable from their helmets for replacement with new path-motion guide mechanisms or for resetting the path-motion guides (e.g. for sports where the helmets are designed for multiple impacts, such as hockey or football). Protrusion 103 may be attached to inner member 100 via one or more suitable fasteners (not shown). After deployment, padding material 108 may be removed, allowing removal of protrusion 103 and separation of inner and outer members 100, 101. With inner member 100 separated from outer member 101, the deployment mechanism could be reset as described above. In some embodiments, compressed material 112A could be removed from slot 102 and new energy-absorbing material 112 could be added to slot 102. In embodiments, where the components of the path-motion guide mechanism are fabricated separately from inner and outer members 100, 101, the components of path motion guide mechanisms may be replaced.

As will be apparent to those skilled in the art in the light of the foregoing disclosure, many alterations and modifications are possible in the practice of this invention without departing from the spirit or scope thereof. For example:

- In the above described embodiments, path-motion guide mechanisms are provided by protrusions which project outwardly from inner members of protective headgear and slots which open inwardly from outer members of the protective headgear. In alternative embodiments, protrusions may project inwardly from outer members of protective headgear and slots may open outwardly from inner members of the protective headgear—i.e. the orientation of the male and female components of path-motion guide mechanisms could be reversed.
- In some of the embodiments described above, path-motion guide mechanism 106 comprises a deployment mechanism 130 which incorporates a piston 132, a bias mechanism 134 an optional breakaway member(s) 140. In other embodiments, deployment mechanism 130 may be provided by breakaway members 140 without piston 132 and bias mechanism 134.
- In the embodiments described above, bias mechanism 134 is provided by a spring 134A. In other embodiments, piston 132 may comprise a hydraulic or pneumatic piston. By way of non-limiting example, the space in piston chamber 146 may be filled with a compressable or deformable material, such as a gas, or foam, or elastomeric polymer. The compressible or deformable material may be adjusted so that the force required for deployment may be modified for a particular user, group of users or particular activity. For example, if a gas is used to fill the space above the piston guide, a series of valves and the like for increasing or decreasing gas pressure in the space may be employed to adjust the force required for deployment, as indicated above.

In other embodiments bias mechanism 134 may be provided by one or more suitably configured actuators.

In the embodiments described above, padding material 108 is located on an insider of inner member 100. In some embodiments, a portion of padding material 108 may be located between inner member 100 and outer member 101.

In other embodiments, protrusion 103 could have other cross-sectional shapes. For example, protrusion 103 could have round, hexagonal, ellipsoidal, oval or polygonal cross-sectional shapes.

Figure 12:
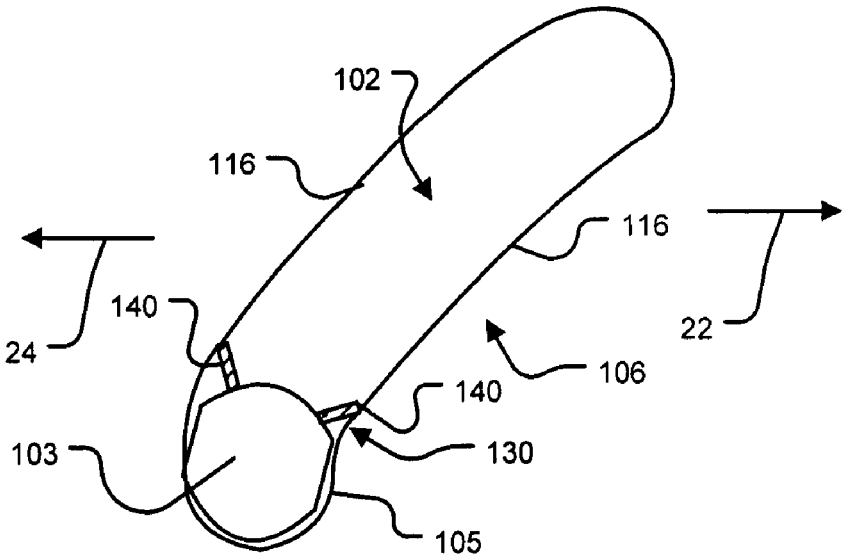
FIG. 12 shows the slot of a path-motion guide mechanism according to another embodiment of the invention.

In the embodiments described above, protrusion can move along posterior branch 102A or anterior branch 102B of slot 102 in response to an axial crown force above the deployment threshold. In some embodiments, slot 102 may comprise only one path. Such an embodiment is illustrated in FIG. 12. In the FIG. 12 embodiment, slot 102 is shaped similarly to anterior branch 102B of the above-described slots. As protrusion 103 moves along slot 102 of the FIG. 12 embodiment, inner member 100 is guided to move in an anterior direction 22 relative to outer member 101 and in direction so as to reduce the separation between inner member 100 and outer member 101. Inner member 100 may also be guided to rotate clockwise relative to outer member 101 and to cause corresponding flexion of the head and neck. In the FIG. 13 embodiment, path-motion guide mechanism comprises a deployment mechanism 130 which comprises a plurality of breakaway members 140. Breakaway members 140 maintain protrusion 103 in base portion 105 unless helmet 99A receives an axial crown force above a threshold level. FIG. 12 represents an exemplary embodiment of a single path slot. It will be appreciated that single path slots 102 could be provided with other shapes, including in particular, a shape similar to that of posterior branch 102A of the above-described slots.

Figure 13:
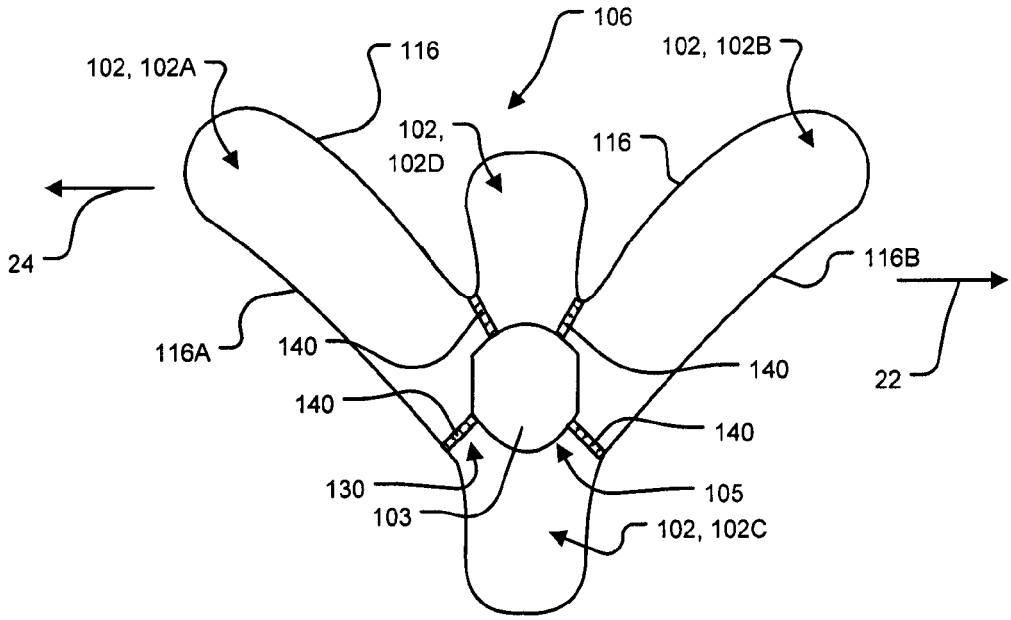
FIG. 13 shows the slot of a path-motion guide mechanism according to another embodiment of the invention.

In some embodiments, slot 102 may comprise more than two branches. Such an embodiment is illustrated in FIG. 13. Slot 102 of FIG. 13 comprises transverse branches 102C, 102D. In the FIG. 13 slot 102, protrusion 103 may move along either one of branches 102A, 102B in a manner similar to that described above. Protrusion 103 may also travel along branch 102C which will cause corresponding rotation of the user's head in one sideways direction or along branch 102D which will cause corresponding rotation of the user's head in the opposing sideways direction. Movement of protrusion 103 along one of branches 102C, 102D will cause corresponding movement of protrusion 103 along a complementary branch 102D, 102C on the opposing side of helmet 99A. For example, if protrusion 103 moves along branch 102C in the FIG. 13 illustration, a corresponding protrusion 103 on the opposing side of helmet 99A will move along a complementary branch 102D and if protrusion 103 moves along branch 102D in the FIG. 13 illustration, the corresponding protrusion 103 on the opposing side of helmet 99A will move along a complementary branch 102C. It will be appreciated that branches 102C, 102D are shown as having particular shapes in FIG. 13, but that branches 102C, 102D may also have some curvature in anterior direction 22 or posterior direction 24, such that the user's head would translate and or rotate according to such curvature. In the FIG. 13 embodiment, path-motion guide mechanism comprises a deployment mechanism 130 which comprises a plurality of breakaway members 140. Breakaway members 140 maintain protrusion 103 in a base location 105 unless helmet 99A receives an axial crown force above a threshold level. FIG. 13 represents only one multiple branch embodiment having more than two branches. Other configurations are possible for providing more than two branches.

In the illustrated embodiment, branches 102A, 102B of slot 102 are symmetric. This is not necessary. There may be circumstances where the various branches are asymmetrical.

In some of the embodiments shown in the accompanying drawings, certain details are not shown in the drawings for clarity. In particular, in some of the drawings energy-absorbing material 112 is not shown. Although optional, energy-absorbing material 112 may be provided in any of the path-motion guide mechanisms described above.

In some embodiments, the path-guide mechanism may be designed to facilitate relative rotation between the inner and outer members about axes that align generally with the spine. Such path-guide mechanisms could be provided using curved branches of slot 102 and/or by allowing a protrusion 103 to rotate within slot 102.

Figure 14:
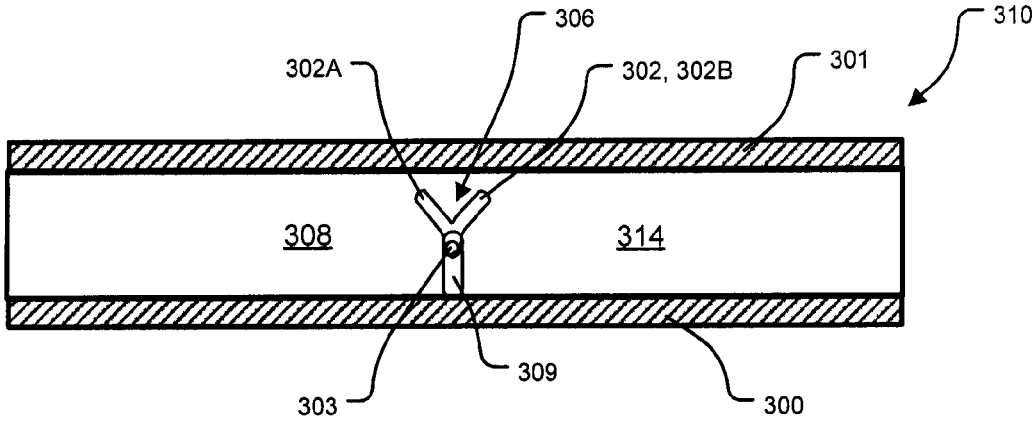
FIG. 14 shows a cross-sectional view of a structure incorporating a path motion guide mechanism according to another embodiment of the invention.

FIG. 14 schematically illustrates another embodiment of the invention, wherein a path motion guide 306 is deployed in a structure 310. Structure 310 may be a structure which occasionally receives impacts from the heads of individuals. By way of non-limiting example, structure 310 may comprise the roof of the interior of a car or the bottom of a pool, for example. Structure 310 may comprise a first layer 300 and a spaced-apart second layer 301. Path motion guide 306 comprises a protrusion 303 which is constrained to move in a slot 302. In the illustrated embodiment, protrusion 303 is connected to or formed with layer 300 via bracket element 309. Slot 302 may be formed in a sidewall 308 of structure 310, for example. Upon impact, layer 300, bracket element 309 and protrusion 303 may move within slot 302. In the illustrated embodiment, slot 302 comprises a pair of branches 302A, 302B down which protrusion 303 may be guided. Slot 302 and/or space 314 between layers 300, 301 may contain energy-absorbing material. Other features of structure 310 and path motion guide 310 may be similar to those of helmet 99A and path motion guide 106 described above.

What is claimed is:

1. A helmet wearable on a head of a user for mitigating neck injury, the helmet comprising:

an outer member, a portion of which is shaped to cover at least one of a crown of the user's head and a back of the user's head, the outer member defining a concavity;

an inner member, at least a portion of which is located within the concavity;

a path-motion guide mechanism coupling the inner member to the outer member, the path-motion guide mechanism permitting guided relative movement between the inner member and the outer member in response to an impact force, the guided relative movement constrained to one or more predetermined paths;

wherein the guided relative movement comprises, for each of the one or more predetermined paths, relative translation and relative rotation between the inner and outer members, wherein the axis of relative rotation moves with the relative translation between the inner and outer members.

2. A helmet according to claim 1 wherein the inner member defines a head-receiving region for receiving the head of the user, the head-receiving region coupleable to the head of the user such that the head moves with the inner member relative to the outer member.

3. A helmet according to claim 2 wherein the one or more predetermined paths comprise a finite plurality of predetermined paths and wherein the guided relative movement, when constrained to a first one of the finite plurality of predetermined paths, comprises translation of the inner member in an anterior direction with respect to the outer member and, when constrained to a second one of the finite plurality of predetermined paths, comprises translation of the inner member in a posterior direction with respect to the outer member.

4. A helmet according to claim 3 wherein the guided relative movement, when constrained to the first one of the finite plurality of predetermined paths, comprises rotation of the inner member relative to the outer member in a first rotational direction where corresponding rotation of the head relative to the outer member in the first rotational direction causes flexion of a neck of the user and, when constrained to the second one of the finite plurality of predetermined paths, comprises rotation of the inner member relative to the outer member in a second rotational direction where corresponding rotation of the head relative to the outer member in the second rotational direction causes extension of the neck of the user.

5. A helmet according to claim 3 wherein the guided relative movement, when constrained to either of the first and second ones of the finite plurality of predetermined paths, comprises relative translation between the inner and outer members in a manner which moves the inner and outer members closer to one another.

6. A helmet according to claim 1 wherein the relative translation between the inner and outer members comprises translation which moves the inner and outer members closer to one another.

7. A helmet according to claim 1 wherein the one or more predetermined paths comprise a finite plurality of predetermined paths.

8. A helmet according to claim 1 wherein the path-motion guide mechanism comprises a protrusion, at least a portion of which is received in a corresponding slot, the slot dimensioned to constrain movement of the protrusion therewithin and to thereby constrain the guided relative movement between the inner and outer members to the one or more predetermined paths.

9. A helmet according to claim 8 wherein the protrusion extends from one of the inner and outer members and the slot is provided in the other one of the inner and outer members.

10. A helmet according to claim 8 wherein the protrusion has a first cross-sectional dimension that is less than or equal to a width of the slot and a second cross-sectional dimension, the second cross-sectional dimension orthogonal to the first cross-sectional dimension and the second cross-sectional dimension greater than the width of the slot.

11. A helmet according to claim 8 wherein the slot comprises a base portion, the protrusion located in the base portion prior to the guided relative movement between the inner and outer members.

12. A helmet according to claim 11 wherein the slot comprises a finite plurality of branches which extend away from the base portion and wherein movement of the protrusion from the base portion along each branch facilitates the guided relative movement between the inner and outer members along a corresponding one of the one or more predetermined paths.

13. A helmet according to claim 12 wherein the finite plurality of branches comprises a third branch and a fourth branch and wherein movement of the protrusion along the third branch is accompanied by relative rotation of the inner member with respect to the outer member in a first transverse rotational direction and movement of the protrusion along the fourth branch is accompanied by relative rotation of the inner member with respect to the outer member in a second transverse rotational direction generally opposed to the first transverse rotational direction.

14. A helmet according to claim 12 wherein movement of the protrusion along a first one of the finite plurality of branches is accompanied by translation of the inner member in an anterior direction with respect to the outer member and wherein movement of the protrusion along a second one of the finite plurality of branches is accompanied by translation of the inner member in a posterior direction with respect to the outer member.

15. A helmet according to claim 14 wherein the protrusion comprises a leading surface which leads the protrusion as it moves away from the base portion along any of the finite plurality of branches and wherein the leading surface is convex and comprises a protrusion apex.

16. A helmet according to claim 15 wherein the slot is defined by one or more slot-defining walls and at least a portion of a slot-defining wall opposing the base portion is convex and comprises a slot apex.

17. A helmet according to claim 16 wherein interaction of the convex leading surface of the protrusion and the convex slot-defining wall portion in response to the impact force determine whether the protrusion will move along the first one of the plurality of branches or the second one of the plurality of branches.

18. A helmet according to claim 17 wherein contact between the convex leading surface of the protrusion and the convex slot-defining wall portion such that the protrusion apex is anterior to the slot apex causes the protrusion to move along the first one of the plurality of branches and contact between the convex leading surface of the protrusion and the convex slot-defining wall portion such that the protrusion apex is posterior to the slot apex causes the protrusion to move along the second one of the plurality of branches.

19. A helmet according to claim 14 wherein movement of the protrusion along either of the first and second ones of the finite plurality of branches is accompanied by relative translation between the inner and outer members in a manner which moves the inner and outer members closer to one another.

20. A helmet according to claim 14 wherein movement of the protrusion along the first one of the finite plurality of branches is accompanied by relative rotation of the inner member with respect to the outer member in a first rotational direction and wherein movement of the protrusion along the second one of the finite plurality of branches is accompanied by relative rotation of the inner member with respect to the outer member in a second rotational direction generally opposed to the first rotational direction.

21. A helmet according to claim 14 wherein the first and second ones of the plurality of branches are curved.

22. A helmet according to claim 11 wherein the slot contains energy-absorbing material which absorbs mechanical energy from the protrusion as the protrusion moves within the slot.

23. A helmet according to claim 22 wherein the energy-absorbing material is deformable under load forces above a threshold and wherein the energy-absorbing material is located in regions of the slot outside of the base portion for helping to maintain the protrusion in the base portion when the protrusion experiences load forces less than the threshold.

24. A helmet according to claim 22 wherein the energy-absorbing material comprises one or more frangible elements.

25. A helmet according to claim 11 wherein the path-motion guide mechanism comprises a deployment mechanism for retaining the protrusion in the base portion when the protrusion experiences load forces less than a deployment threshold.

26. A helmet according to claim 25 wherein the deployment mechanism comprises a piston and a bias mechanism configured to bias the piston against the protrusion when the protrusion is in the base portion.

27. A helmet according to claim 26 wherein the bias mechanism comprises one or more of: a spring; a resiliently deformable material; and pressurized fluid.

28. A helmet according to claim 25 wherein the deployment mechanism comprises one or more breakaway members which extend between the protrusion and one or more slot-defining walls which define the slot, the breakaway members fracturing under load forces above the deployment threshold.

29. A helmet according to claim 25 wherein the deployment mechanism comprises one or more hinged members and one or more hinge bias mechanisms, each hinge bias mechanism configured to bias a corresponding one of the hinged members in such a manner as to help maintain the protrusion in the base portion.

30. A helmet according to claim 25 wherein the deployment mechanism comprises:

a sensor for sensing at least one of force and pressure;

one or more actuatable elements for maintaining the protrusion in the base portion; and a controller connected to receive output from the sensor and configured to actuate the actuatable elements in such a manner as to allow the protrusion to move out of the base portion when the controller determines that the output of the sensor is indicative of a load force on the protrusion above the deployment threshold.

31. A helmet according to claim 1 wherein the helmet comprises energy absorbing material between the concavity of the outer member and the portion of the inner member located within the concavity.

32. A helmet wearable on a head of a user for mitigating injury, the helmet comprising:

an outer member, defining a concavity;

an inner member, at least a portion of which is located within the concavity;

a path-motion guide mechanism coupling the inner member to the outer member, the path-motion guide mechanism permitting guided relative movement between the inner member and the outer member in response to an impact force, the guided relative movement constrained to one or more predetermined paths;

wherein the guided relative movement comprises, for each of the one or more predetermined paths, relative translation and relative rotation between the inner and outer members, wherein the axis of relative rotation moves with the relative translation between the inner and outer members;

wherein the path-motion guide mechanism comprises a protrusion, at least a portion of which is received in a corresponding slot, the slot dimensioned to constrain movement of the protrusion therewithin and to thereby constrain the guided relative movement between the inner and outer members to the one or more predetermined paths; and wherein the protrusion has a first cross-sectional dimension that is less than or equal to a width of the slot and a second cross-sectional dimension that is orthogonal to both the first cross-sectional dimension and to a depth of the slot, the second cross-sectional dimension greater than the width of the slot.

33. A helmet wearable on a head of a user for mitigating injury, the helmet comprising:

an outer member, defining a concavity;

an inner member, at least a portion of which is located within the concavity;

a path-motion guide mechanism coupling the inner member to the outer member, the path-motion guide mechanism permitting guided relative movement between the inner member and the outer member in response to an impact force, the guided relative movement constrained to one or more predetermined paths;

wherein the guided relative movement comprises, for each of the one or more predetermined paths, relative translation and relative rotation between the inner and outer members, wherein the axis of relative rotation moves with the relative translation between the inner and outer members;

wherein the path-motion guide mechanism comprises a protrusion, at least a portion of which is received in a corresponding slot, the slot dimensioned to constrain movement of the protrusion therewithin and to thereby constrain the guided relative movement between the inner and outer members to the one or more predetermined paths; and wherein the slot contains energy-absorbing material which absorbs mechanical energy from the protrusion as the protrusion moves within the slot.

34. A helmet wearable on a head of a user for mitigating injury, the helmet comprising:

an outer member, defining a concavity;

an inner member, at least a portion of which is located within the concavity;

a path-motion guide mechanism coupling the inner member to the outer member, the path-motion guide mechanism permitting guided relative movement between the inner member and the outer member in response to an impact force, the guided relative movement constrained to one or more predetermined paths;

wherein the guided relative movement comprises, for each of the one or more predetermined paths, relative translation and relative rotation between the inner and outer members, wherein the axis of relative rotation moves with the relative translation between the inner and outer members;

wherein the path-motion guide mechanism comprises a protrusion, at least a portion of which is received in a corresponding slot, the slot dimensioned to constrain movement of the protrusion therewithin and to thereby constrain the guided relative movement between the inner and outer members to the one or more predetermined paths;

wherein the slot comprises a base portion, the protrusion located in the base portion prior to the guided relative movement between the inner and outer members; and wherein the path-motion guide mechanism comprises a deployment mechanism for retaining the protrusion in the base portion when the protrusion experiences load forces less than a deployment threshold.

* * * * *